US005630889A

United States Patent [19]

Karabin

[11] Patent Number: 5,630,889

[45] Date of Patent: May 20, 1997

[54] VANADIUM-FREE ALUMINUM ALLOY SUITABLE FOR EXTRUDED AEROSPACE PRODUCTS

[75] Inventor: Lynette M. Karabin, Ruffdale, Pa.

[73] Assignee: Aluminum Company of America, Pittsburgh, Pa.

[21] Appl. No.: 408,426

[22] Filed: Mar. 22, 1995

[51] Int. Cl.[6] ..... C22C 21/12

[52] U.S. Cl. ..... 148/417; 148/439; 420/533; 420/534; 420/535; 420/539

[58] Field of Search ..... 420/533, 534, 420/535, 539, 541, 542, 543, 544, 553, 417, 418, 439

[56] References Cited

U.S. PATENT DOCUMENTS

| | | | |
|---|---|---|---|
| Re. 15,407 | 7/1922 | Frary | 420/533 |
| Re. 26,907 | 6/1970 | Doyle et al. | 420/535 |
| 995,113 | 6/1911 | Claessen | 420/533 |
| 1,099,561 | 6/1914 | McAdams | 420/539 |
| 1,130,785 | 3/1915 | Wilm | 420/533 |
| 1,261,987 | 4/1918 | Wilm | 420/529 |
| 2,242,944 | 5/1941 | Dix, Jr. et al. | 148/417 |
| 2,388,540 | 11/1945 | Hartmann | 148/417 |
| 2,749,239 | 6/1956 | Sicha et al. | 420/533 |
| 2,823,994 | 2/1958 | Rosenkranz | 420/532 |
| 3,288,601 | 11/1966 | Flemings et al. | 420/535 |
| 3,333,990 | 8/1967 | Brown et al. | 148/417 |
| 3,414,406 | 12/1968 | Doyle et al. | 420/535 |
| 3,475,166 | 10/1969 | Raffin | 420/532 |
| 3,561,954 | 2/1971 | Brook | 420/534 |
| 3,598,577 | 8/1971 | Stonebrook | 420/532 |
| 3,759,758 | 9/1973 | Hatano et al. | 148/417 |
| 3,925,067 | 12/1975 | Sperry et al. | 420/535 |
| 4,062,704 | 12/1977 | Sperry et al. | 420/533 |
| 4,063,936 | 12/1977 | Nagase et al. | 420/532 |
| 4,336,075 | 6/1982 | Quist et al. | 148/439 |
| 4,610,733 | 9/1986 | Sanders, Jr. et al. | 148/418 |
| 4,711,762 | 12/1987 | Vernam et al. | 420/532 |
| 4,740,250 | 4/1988 | Ahn et al. | 148/417 |
| 4,772,342 | 9/1988 | Polmear | 148/418 |
| 4,848,647 | 7/1989 | Gentry et al. | 420/532 |
| 4,906,885 | 3/1990 | Kojima et al. | 420/533 |
| 5,259,897 | 11/1993 | Pickens et al. | 148/417 |
| 5,376,192 | 12/1994 | Cassada, III | 148/417 |

FOREIGN PATENT DOCUMENTS

| | | |
|---|---|---|
| 863262 | 2/1971 | Canada . |
| 48-38282 | 7/1970 | Japan . |
| 53-113710 | 10/1978 | Japan . |
| 54-10214 | 1/1979 | Japan . |
| 56-39379 | 9/1981 | Japan . |
| 58-18418 | 4/1983 | Japan . |
| 59-123735 | 7/1984 | Japan . |
| 62-83445 | 4/1987 | Japan . |
| 3-107440 | 5/1991 | Japan . |

(List continued on next page.)

OTHER PUBLICATIONS

"The Influence of Small Additions of Silver on the Ageing of Aluminium Alloys: Observations on Al–Cu–Mg Alloys", J. T. Vietz and I. J. Polmear, *Journal of the Institute of Metals,* 1966, vol. 94, pp. 410–419.

(List continued on next page.)

*Primary Examiner*—George Wyszomierski
*Attorney, Agent, or Firm*—Gary P. Topolosky

[57] ABSTRACT

An extruded structural member suitable for aerospace applications and having improved combinations of strength and toughness. The member is made from a substantially vanadium-free aluminum-based alloy consisting essentially of: about 4.85–5.3 wt. % copper, about 0.5–1.0 wt. % magnesium, about 0.4–0.8 wt. % manganese, about 0.2–0.8 wt. % silver, about 0.05–0.25 wt. % zirconium, up to about 0.1 wt. % silicon, and up to about 0.1 wt. % iron, the balance aluminum, incidental elements and impurities, the Cu:Mg ratio of said alloy being between about 5 and 9, and more preferably between about 6.0 and 7.5. The invention exhibits a typical tensile yield strength of about 77 ksi or higher at room temperature and can be forged into aircraft wheels or extruded into various other product forms for use as high speed aircraft wing members, e.g. stringers or the like.

18 Claims, 5 Drawing Sheets

FOREIGN PATENT DOCUMENTS

| | | |
|---|---|---|
| 3-223437 | 10/1991 | Japan . |
| 26322 | 7/1908 | United Kingdom . |
| 1089454 | 11/1967 | United Kingdom . |
| 1090960 | 11/1967 | United Kingdom . |
| 1289621 | 9/1972 | United Kingdom . |
| 1320271 | 6/1973 | United Kingdom . |
| 1387961 | 3/1975 | United Kingdom . |
| WO89/01531 | 2/1989 | WIPO . |
| WO91/11540 | 8/1991 | WIPO . |

OTHER PUBLICATIONS

"The Effects of Small Additions of Silver on the Aging of Some Aluminum Alloys", I. J. Polmear, *Transactions of the Metallurgical Society of AIME,* vol. 230, Oct. 1964, pp. 1331–1339.

"The Effect of an Addition of 0.5 wt.–% Silver on the Ageing Characteristics of Certain Al–Cu–Mg Alloys", N. Sen and D.R.F. West, The Mechanism of Phase Transformations in Crystalline Solids, Proceedings of International Symposium by the Institute of Metals, University of Manchester, Jul. 3 to 5, 1968, Monograph & Report Series No. 33, pp. 49–53.

"Design and Development of an Experimental Wrought Aluminum Alloy for Use at Elevated Temperatures", I. J. Polmear and M. J. Couper, *Metallurgical Transactions A,* vol. 19A, Apr. 1988, pp. 1027–1035.

"Precipitation in Al–Cu–Mg–Ag Alloys", R.J. Chester & I.J. Polmear, *The Metallurgy of Light Alloys,* Spring Residential Conference, No. 20, Mar. 1983, 1601–83–Y, pp. 75–79.

EFFECT OF V IN

Al - 5.0 Cu - 0.8 Mg - 0.6 Mn - 0.5 Ag - 0.13 Zr

EFFECT OF V IN Al - 5.0 Cu - 0.8 Mg - 0.6 Mn

VANADIUM-FREE ALUMINUM ALLOY SUITABLE FOR EXTRUDED AEROSPACE PRODUCTS

BACKGROUND OF THE INVENTION

1. Field of the Invention

This invention relates to the field of age-hardenable aluminum alloys suitable for aerospace and other demanding applications. The invention further relates to new aluminum alloy products having improved combinations of strength and toughness suitable for high speed aircraft applications, especially fuselage skins and wing members. For such applications, resistance to creep and/or stress corrosion cracking may be critical. This invention further relates to other high temperature aluminum alloy applications like those required for the wheel and brake parts of such aircraft. Particular product forms for which this invention are best suited include sheet, plate, forgings and extrusions.

2. Technology Review

One important means for enhancing the strength of aluminum alloys is by heat treatment. Three basic steps generally employed for the heat treatment of many aluminum alloys are: (1) solution heat treating; (2) quenching; and (3) aging. Some cold working may also be performed between quenching and aging. Solution heat treatment consists of soaking a alloy at a sufficiently high temperature and for a long enough time to achieve a near homogeneous solid solution of precipitate-forming elements within the alloy. The objective is to take into solid solution the most practical amount of soluble-hardening elements. Quenching, or rapid cooling of the solid solution formed during solution heat treatment, produces a supersaturated solid solution at room temperature. Aging then forms strengthening precipitates from this rapidly cooled, supersaturated solid solution. Such precipitates may form naturally at ambient temperatures or artificially using elevated temperature aging techniques. In natural aging, quenched alloy products the held at temperatures ranging from −20° to +50° C., but most typically at room temperature, for relatively long periods of time. For some alloy compositions, precipitation hardening from just natural aging produces materials with useful physical and mechanical properties. In artificial aging, a quenched alloy is held at temperatures typically ranging from 100° to 190° C., for time periods typically ranging from 5 to 48 hours, to cause some precipitation hardening in the final product.

The extent to which an aluminum alloy's strength can be enhanced by heat treatment varies with the type and amount of alloying constituents present. For example, adding copper to aluminum improves alloy strength and, in some instances, even enhances weldability to some point. The further addition of magnesium to such Al-Cu alloys can improve that alloy's resistance to corrosion, enhance its natural aging response (without prior cold working) and even increase its strength somewhat. At relatively low Mg levels, however, that alloy's weldability may decrease.

One commercially available alloy containing both copper and magnesium is 2024 aluminum (Aluminum Association designation). A representative composition within the range of 2024 is 4.4 wt. % Cu, 1.5 wt. % Mg, 0.6 wt. % Mn and a balance of aluminum, incidental elements and impurities. Alloy 2024 is widely used because of its high strength, good toughness, and good natural-aging response. In some tempers, it suffers from limited corrosion resistance, however.

Another commercial Al-Cu-Mg alloy is sold as 2519 aluminum (Aluminum Association designation). This alloy has a representative composition of 5.8 wt. % Cu, 0.2 wt. % Mg, 0.3 wt. % Mn, 0.2 wt. % Zr, 0.06 wt. % Ti, 0.05 wt. % V and a balance of aluminum, incidental elements and impurities. Alloy 2519, developed as an improvement to alloy 2219, is presently used for some military applications including armor plate.

According to U.S. Pat. No. 4,772,342, Polmear added silver to an Al-Cu-Mg-Mn-V system to increase the elevated temperature properties of that alloy. One representative embodiment from that patent has the composition 6.0 wt. % Cu, 0.5 wt. % Mg, 0.4 wt. % Ag, 0.5 wt. % Mn, 0.15 wt. % Zr, 0.10 wt. % V, 0.05 wt. % Si and a balance of aluminum. According to Polmear, the increase in strength which he observed was due to a plate-like Ω phase on the {111} planes arising when both Mg and Ag are present. While the typical tensile yield strengths of Polmear's extruded rod sections measured up to 75 ksi, this invention could not repeat such strength levels for other property forms. When sheet product was made using Polmear's preferred composition range for comparative purposes, such sheet product only exhibited typical tensile yield strengths of about 70 ksi compared to the 77 ksi or higher typical strength levels observed with sheet product equivalents of this invention. Even higher typical strength levels are expected from the extrusion products of this invention since extruded rod and bars are known to develop enhanced texture strengthening.

SUMMARY OF THE INVENTION

It is a principal objective of this present invention to provide aerospace alloy products having improved combinations of strength and fracture toughness. It is another objective to provide such alloy products with good long time creep resistance, typically less than 0.1% creep after 60,000 hours at 130° C. and 150 MPa.

It is yet another objective to provide an improved aircraft alloy which will not require high levels of cold working to enhance the development of high strength levels, especially for product forms like forgings and extrusions, it being understood that some stretching may always be required to straighten out sheet or plate product forms. It being further understood that such extrusions would be capable of being drawn into still other product forms. Still another objective is to produce Al-Cu-Mg-Ag-Mn alloy products with an overall enhanced fracture toughness performance. It is another objective to provide such alloy products with higher strengths at equal or greater toughness performance levels when compared with non-extruded product forms made according to Polmear's patented, vanadium-containing composition.

Yet another main objective is to provide aerospace alloy products suitable for use as fuselage and/or wing skins on the next generation, supersonic transport planes. Still another objective is to provide an alloy suitable for the higher temperature forging applications often associated with the wheel and brake parts for subsonic and supersonic aircraft. Typical brake parts include aircraft disc rotors and calipers, though it is to be understood that other brake parts, such as brake drums, may also be manufactured therefrom for aerospace and other high temperature vehicular applications.

Another objective is to provide 2000 Series aluminum alloy products with little to no Θ constituents. Yet another objective is to provide those alloy products with improved stress corrosion cracking resistance. Still another objective is to provide aluminum alloy products with better strength/toughness combinations than 2219 aluminum, and better thermal stability than 2048, 6013 or 8090/8091 aluminum.

These and other advantages of this invention are achieved with an age-formable, aerospace structural part having improved combinations of strength and toughness. The part is made from a substantially vanadium-free, aluminum-based alloy consisting essentially of: about 4.85–5.3 wt. % copper, about 0.5–1.0 wt. % magnesium, about 0.4–0.8 wt. % manganese, about 0.2–0.8 wt. % silver, about 0.05–0.25 wt. % zirconium, up to about 0.1 wt. % silicon, and up to about 0.1 wt. % iron, the balance aluminum, incidental elements and impurities. Sheet and plate products made with an alloy of that composition exhibit typical tensile yield strengths of about 77 ksi or higher at room temperature. The invention can also be made into aircraft wheels and brake parts by forging or other known practices, or into various extrusion products, including but not limited to aircraft wing stringers or other drawn extruded products.

The alloy products of this invention differ from those described in the Polmear patent in several regards, namely: (a) this invention recognizes that Ag additions enhance the achievable strengths of T6-type tempers, but that Ag has a much smaller effect on T8-type strengths; (b) for the Al-Cu-Mg-Ag alloys with higher Cu:Mg ratios studied by Polmear, T6- and T8-type strengths are similar. But as this Cu:Mg ratio decreases, the effects of stretching per T8-type processing becomes beneficial; (c) these alloy products demonstrate that typical strengths even higher than reported by Polmear for extrusions can be achieved in rolled and forged product forms when the Cu:Mg ratio of Polmear is reduced to an intermediate level and when some stretching prior to artificial aging may be utilized; (d) this invention identifies the preferred (i.e., intermediate) Cu:Mg ratios required to achieve such very high typical strength levels; (e) it further recognizes the importance of Mn additions for texture strengthening; (f) the invention identifies Zn as a potential partial substitute for more costly Ag additions in alternate embodiments of this invention; and (g) it does not rely on vanadium for performance enhancements.

BRIEF DESCRIPTION OF THE DRAWINGS

Further features, objectives and advantages of the present invention shall become clearer from the following detailed description made with reference to the drawings in which.

DETAILED DESCRIPTION OF PREFERRED EMBODIMENTS

Figure 1:
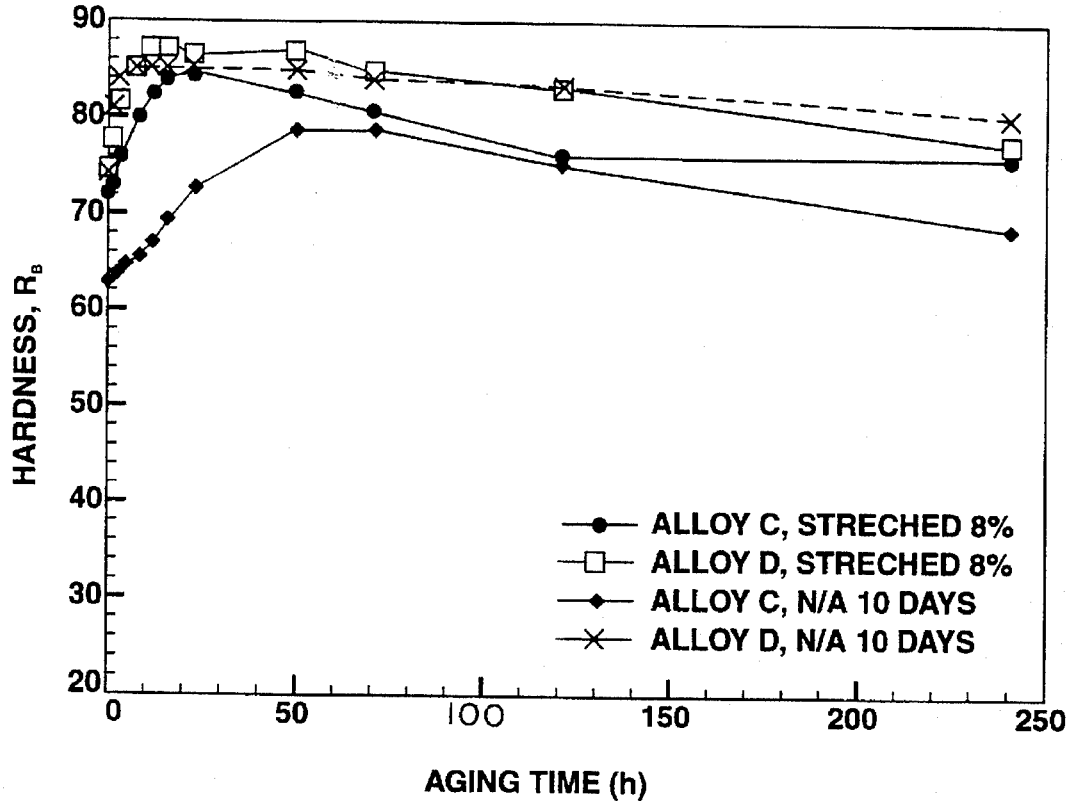
FIG. 1 is a graph comparing the Rockwell B hardness values as a function of aging time for invention alloy samples C and D from Table I, specimens of both alloy samples having been stretched by 8%, or naturally aged for 10 days prior to artificial aging at 325° F.

Definitions: For the description of preferred alloy compositions that follows, all references to percentages are by weight percent (wt. %) unless otherwise indicated.

When referring to any numerical range of values herein, such ranges are understood to include each and every number and/or fraction between the stated range minimum and maximum. A range of about 4.85–5.3% copper, for example, would expressly include all intermediate values of about 4.86, 4.87, 4.88 and 4.9% all the way up to and including 5.1,5.25 and 5.29% Cu. The same applies to all other elemental ranges set forth below such as the intermediate Cu:Mg ratio level of between about 5 and 9, and more preferably between about 6.0 and 7.5.

When referring to minimum versus typical strength values herein, it is to be understood that minimum levels are those at which a material's property value can be guaranteed or those at which a user can rely for design purposes subject to a safety factor. In some cases, "minimum" yield strengths have a statistical basis such that 99% of that product either conforms or is expected to conform to that minimum guaranteed with 95% confidence. For purposes of this invention, typical strength levels have been compared to Polmear's typical levels as neither material has been produced (a) on place scale; and (b) in sufficient quantities as to measure a statistical minimum therefor. And while typical strengths may tend to run a little higher than the minimum guaranteed levels associated with plant production, they at least serve to illustrate an invention's improvement in strength properties when compared to other typical values in the prior art.

As used herein, the term "substantially-free" means having no significant amount of that component purposefully added to the composition to import a certain characteristic to that alloy, it being understood that trace amounts of incidental elements and/or impurities may sometimes find their way into a desired end product. For example, a substantially vanadium-free alloy should contain less than about 0.1% V, or more preferably less than about 0.03% V, due to contamination from incidental additives or through contact with certain processing and/or holding equipment. All preferred first embodiments of this invention are substantially vanadium-free. On a preferred basis, these same alloy products are also substantially free of cadmium and titanium.

BACKGROUND OF THE INVENTION

Recently, there has been increased interest in the design and development of a new supersonic transport plane to eventually replace the Anglo/French Concorde. The high speed civil transport (HSCT) plane of the future presents a need for two new materials: a damage tolerant material for the lower wing and fuselage; and a high specific stiffness material for the plane's upper wing. An additional set of requirements will be associated with performance both at and after elevated temperature exposures.

Aircraft wheel and brake parts are another application where aluminum alloys need enhanced performance at elevated temperatures. Wheel and brake assemblies for future high speed aircraft will require advances in thermal stability and performance especially when compared to incumbent alloys such as 2014-T6 aluminum.

Of conventional ingot metallurgy alloys, 2219 and 2618 aluminum are the two currently registered alloys generally considered for elevated temperature use. Both were registered with the Aluminum Association in the mid 1950's. A nominal composition for alloy 2219 is 6.3 wt. % Cu, 0.3 wt. % Mn, 0.1 wt. % V, 0.15 wt. % Zr, and a balance of aluminum, incidental elements and impurities. For alloy 2618, a nominal composition contains 2.3 wt. % Cu, 1.5 wt. % Mg, 1.1 wt. % Fe, 1.1 wt. % Ni and a balance of aluminum, incidental elements and impurities. Both belong to the 2000 Series Al-Cu-Mg systems, but because of different Cu:Mg ratios, these two alloys are believed to be strengthened by different means: 2219 generally by Θ' precipitates, and 2618 generally by S' precipitates.

Proposed End Uses (a) Sheet and Plate Products

While the next generation of high speed civil transport (HSCT) aircraft may not be faster than today's Concorde, they will be expected to be larger, travel longer distances, and carry more passengers so as to operate at more competitive costs with subsonic aircraft. For such next generation aircraft, a more damage tolerant material will be desired for both the lower wing and fuselage members.

Although different airframers may have different conceptual designs, each emphasizes speeds of Mach 2.0 to 2.4 with operating stresses of 15 to 20 ksi. Future damage tolerant materials will be expected to meet certain requirements associated with thermal exposures at the high temperatures representative of such supersonic service, namely: (a) a minimal loss in ambient temperature properties should occur during the lifetime of the aircraft; (b) properties at supersonic cruise temperatures should be sufficient; and (c) minimal amounts of allowable creep during the plane's lifetime. For many of the testS described below, it should be noted that exposures at 300° F. for 100 hours were intended to simulate Mach 2.0 service.

(b) Forgings

Aluminum aircraft wheels, including those for future HSCT aircraft, will be repeatedly exposed to elevated temperatures. With today's braking systems, such wheels must have stable properties for extended periods of service at 200° F. and be fully usable after brief excursions to temperatures as high as 400° F. These same wheels must not catastrophically fail on a rejected take-off during which temperatures may reach 600° F. As more advanced braking systems are developed, such temperatures are expected to increase by 100°–150° F. For future applications, the following properties could be most critical for aircraft wheels: ambient specific strengths, corrosion resistance, elevated temperature strength and fatigue resistance. Properties of secondary importance would include machinability, ductility, creep resistance, fracture toughness, fatigue crack growth and strength after elevated temperature exposure.

Promising strength levels were obtained for several alloy samples produced as small 2 lb. ingots and compared for this invention. Another set of sample alloy compositions were run on direct chill cast, large (i.e., greater than 500 lb.) laboratory ingots. Sets of 20 lb. alloy ingots were also prepared to study the effect of combining both Ag and Zn in the invention alloy. Sample 'alloy compositions, which cover Cu:Mg ratios ranging from 2.9 to 20, various Mn levels and alternating levels of Ag and/or Zn, are summarized in Tables I, II and III.

TABLE I

Chemical Analyses for Al—Cu—Mg—Mn—(Ag) Alloy samples Produced as 1¼" × 2¾" × 6" Book Mold Ingots

| Sample | Cu | Mg | Mn | V | Zr | Fe | Si | Ag |
|---|---|---|---|---|---|---|---|---|
| A | 4.4 | 1.5 | 0.6 | 0.01 | 0.00 | 0.00 | 0.00 | — |
| B | 4.5 | 1.5 | 0.6 | 0.00 | 0.00 | 0.01 | 0.00 | 0.5 |
| C | 5.1 | 0.8 | 0.6 | 0.01 | 0.00 | 0.00 | 0.00 | — |
| D | 5.1 | 0.8 | 0.6 | 0.00 | 0.00 | 0.00 | 0.00 | 0.5 |
| E | 5.8 | 0.3 | 0.6 | 0.01 | 0.00 | 0.00 | 0.00 | — |
| F | 6.0 | 0.3 | 0.6 | 0.01 | 0.00 | 0.01 | 0.00 | 0.5 |
| G | 5.2 | 0.7 | 0.06 | 0.00 | 0.00 | 0.00 | 0.00 | — |
| H | 5.3 | 0.8 | 0.06 | 0.00 | 0.00 | 0.00 | 0.00 | 0.6 |
| I | 5.9 | 0.3 | 0.06 | 0.00 | 0.00 | 0.00 | 0.00 | — |
| J | 6.0 | 0.3 | 0.05 | 0.00 | 0.00 | 0.00 | 0.00 | 0.5 |
| K | 4.4 | 1.6 | 0.6 | 0.00 | 0.00 | 0.01 | 0.00 | 0.5 |
| L | 5.0 | 0.8 | 0.6 | 0.00 | 0.00 | 0.00 | 0.00 | 0.5 |
| M | 6.0 | 0.3 | 0.6 | 0.01 | 0.00 | 0.00 | 0.00 | 0.5 |

TABLE II

Chemical Analyses for Al—Cu—Mg—Mn (Ag) Alloy samples Produced as DC Cast 6" × 16" × 60" Ingots

| Sample | Cu | Mg | Mn | V | Zr | Fe | Si | Ag |
|---|---|---|---|---|---|---|---|---|
| N | 5.71 | 0.18 | 0.29 | 0.09 | 0.15 | 0.05 | 0.06 | — |
| P | 5.83 | 0.52 | 0.30 | 0.10 | 0.14 | 0.05 | 0.05 | — |
| Q | 5.75 | 0.52 | 0.30 | 0.09 | 0.16 | 0.06 | 0.05 | 0.49 |
| R | 5.18 | 0.82 | 0.00 | 0.00 | 0.16 | 0.05 | 0.05 | 0.50 |
| S | 5.12 | 0.82 | 0.60 | 0.13 | 0.15 | 0.06 | 0.05 | 0.49 |
| T | 5.23 | 0.82 | 0.59 | 0.10 | 0.14 | 0.07 | 0.05 | — |
| U | 6.25 | 0.52 | 0.60 | 0.10 | 0.15 | 0.05 | 0.05 | 0.51 |
| V | 6.62 | 0.51 | 1.01 | 0.10 | 0.15 | 0.06 | 0.05 | 0.51 |

TABLE III

Chemical Analyses for Al—Cu—Mg—Mn (Ag, Zn) Alloy samples Produced as 2" × 10" × 12" Book Mold Ingots

| Sample | Cu | Mg | Mn | V | Zr | Fe | Si | Ag | Zn |
|---|---|---|---|---|---|---|---|---|---|
| W | 4.63 | 0.80 | 0.61 | — | 0.17 | 0.06 | 0.04 | 0.51 | 0.00 |
| X | 4.66 | 0.81 | 0.62 | — | 0.17 | 0.06 | 0.04 | 0.00 | 0.36 |
| Y | 4.62 | 0.80 | 0.62 | — | 0.16 | 0.06 | 0.04 | 0.25 | 0.16 |
| Z | 4.88 | 0.81 | 0.60 | 0.01 | 0.13 | 0.07 | 0.05 | 0.50 | 0.00 |
| AA | 5.02 | 0.84 | 0.61 | 0.10 | 0.13 | 0.06 | 0.05 | 0.53 | 0.01 |
| BB | 4.75 | 0.83 | 0.62 | 0.02 | 0.00 | 0.05 | 0.05 | 0.00 | 0.00 |
| CC | 4.97 | 0.84 | 0.61 | 0.02 | 0.00 | 0.06 | 0.05 | 0.53 | 0.00 |
| DD | 4.97 | 0.84 | 0.62 | 0.11 | 0.00 | 0.07 | 0.05 | 0.53 | 0.00 |

Table IV shows the effect of Ag additions on Rockwell B hardness values and tensile strengths of Al-Cu-Mg-Mn-(Ag) alloy samples aged according to T6- and T8-type tempers. Alloy samples with and without silver have been grouped with comparative samples having similar Cu:Mg ratios.

TABLE IV

Typical Tensile Data and Rockwell B Hardness Values for Al—Cu—Mg—Mn—(Ag) Products Aged Using T6-Type and TB-Type Practices, Illustrating the Effect of Ag

| | | | | T6-type (b) | | | T8-type (c) | | | |
|---|---|---|---|---|---|---|---|---|---|---|
| Sample (a) | Description | Ag (wt %) | HRB | Tensile Yield Strength (ksi) | Ultimate Tensile Yield Strength (ksi) | Elongation (%) | HRB | Tensile Yield Strength (ksi) | Ultimate Tensile Yield Strength (ksi) | Elongation (%) |
| A | low Cu:Mg | — | 77.8 | *n.m. | n.m. | n.m. | 87.0 | 75.5 | 78.2 | 9.0 |
| B | low Cu:Mg | 0.5 | 82.0 | n.m. | n.m. | n.m. | 87.4 | 77.0 | 79.4 | 10.0 |
| C | intermed. Cu:Mg | — | 78.6 | 54.0 | 68.0 | 15.0 | 84.8 | 72.6 | 74.8 | 9.0 |
| D | intermed. Cu:Mg | 0.5 | 85.9 | 67.3 | 74.5 | 11.0 | 87.6 | 75.4 | 77.5 | 11.0 |
| E | high Cu:Mg | — | 77.4 | 49.5 | 66.7 | 16.0 | 83.0 | 67.7 | 72.9 | 11.0 |
| F | high Cu:Mg | 0.5 | 84.0 | 63.9 | 71.3 | 10.0 | 84.8 | 68.7 | 74.0 | 12.0 |
| P | high Cu:Mg | — | n.m. | 60.5 | 69.3 | 10.5 | 82.3 | 70.3 | 74.0 | 13.0 |
| Q | high Cu:Mg | 0.5 | n.m. | 68.3 | 74.0 | 10.0 | 84.9 | 70.4 | 74.4 | 11.0 |
| T | intermed. Cu:Mg | — | 80.8 | 60.5 | 73.4 | 15.0 | 85.0 | 74.5 | 76.7 | 9.5 |
| S | intermed. Cu:Mg | 0.5 | 87.8 | 74.2 | 81.3 | 11.0 | 87.9 | 76.2 | 78.8 | 9.5 |
| W | intermed. Cu:Mg | — | n.m. | 65.3 | 72.6 | 13 | n.m. | 74.6 | 76.4 | 10.0 |
| X | intermed. Cu:Mg | 0.5 | n.m. | 72.5 | 77.4 | 13 | n.m. | 77.3 | 80.1 | 12.6 |
| BB | intermed. Cu:Mg | — | n.m. | 67.0 | 73.6 | 10 | | 73.6 | 76.2 | 8.5 |
| CC | intermed. Cu:Mg | 0.5 | n.m. | 73.0 | 77.9 | 9 | | 79.3 | 82.2 | 9.0 |

*n.m. = not measured (a) Samples A, B, C, D, E and F were cast as 1¼" × 2¾" × 6" ingots and rolled to sheet. Samples P, Q, T and S were direct chill cast as 6" × 16" × 60" ingots. Samples W, X, BB and CC were cast as 2" × 10" × 12" ingots and rolled to sheet.

(b) For samples A, B, C, D, E and F, typical T6-type properties were obtained from sheet which had been heat treated, quenched, naturally aged 10 days and artificially aged at 325° F. For samples P and Q, typical T6-type properties were obtained from sheet which had been heat treated, quenched, stretched <1% to straighten and artificially aged at 350° F. For samples T and S, typical T6-type properties were obtained from forgings which had been heat treated, quenched and artificially aged at 350° F. For samples W, X, BB and CC, typical T6-type properties were obtained from sheet which had been heat treated, quenched, stretched 0.5% and aged at 325° F.

(c) For all samples, typical T8-type properties were obtained from sheet which had been heat treated, quenched, stretched 8%, and artificially aged at temperatures between 325° F. and 350° F.

Effect of Ag

Silver additions dramatically improve the typical T6-type strengths and Rockwell hardness values of Al-Cu-Mg-Mn alloy samples. For example, a typical tensile yield strength as high as 74.2 ksi was achieved in alloy sample S as compared to the 60.5 ksi value measured for a companion silver-free, unstretched alloy such as alloy sample T from Table IV.

When Ag is present, and a small amount of cold work (e.g. <1% stretching) has been introduced prior to artificial aging to flatten sheet product for typical T6-type aging conditions, these T6-type tensile yield strengths were observed to be generally similar to those for typical T8-type tensile yield strengths where a greater amount of cold work has been introduced. For example, a typical tensile yield strength of 70.4 ksi for the T8-type temper is roughly equivalent to a typical 68.3 ksi tensile yield strength for the T6-type temper of the same material (e.g., alloy sample Q in Table IV).

FIG. 1 demonstrates this effect for the hardnesses of two alloy samples having intermediate Cu:Mg ratios, alloy samples C and D from Table I. The Ag-bearing example in this comparison, alloy sample D, achieves nearly the same level of hardness regardless of whether it is 8% stretched or naturally aged for 10 days prior to artificial aging. The Ag-free alloy sample C, however, achieves a much higher hardness when stretched by 8% rather than just naturally aged for 10 days.

Cu:Mg Ratios

Figure 2A:
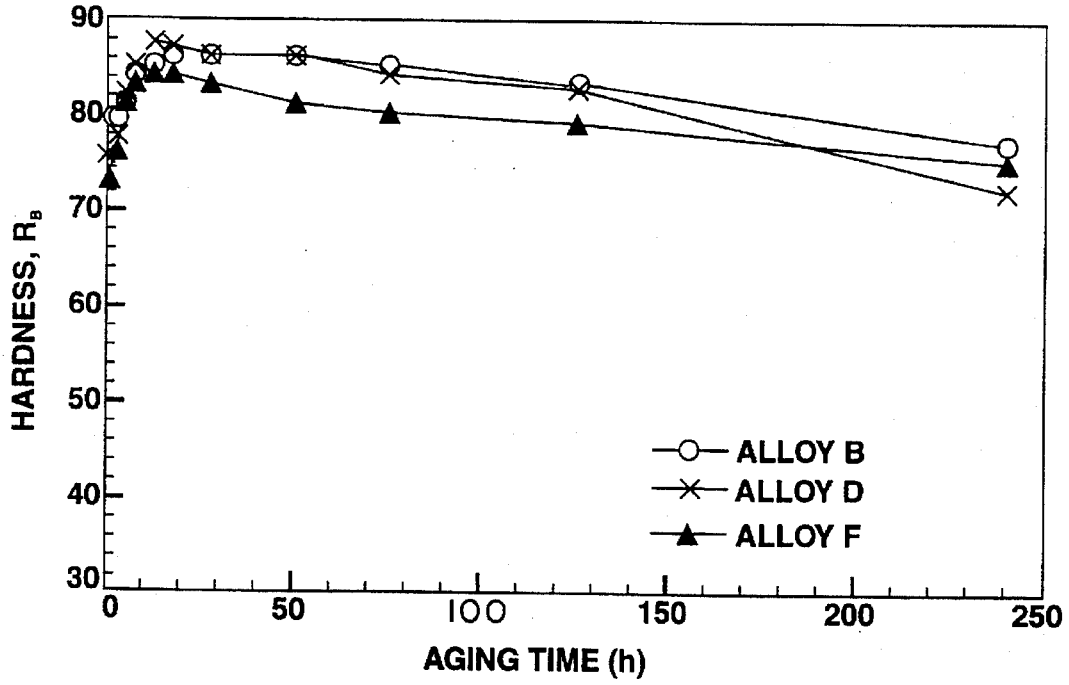
FIG. 2*a* is a graph comparing the Rockwell B hardness value for three silver bearing Al-Cu-Mg-Mn alloy samples B, D and F from Table I, all of which were stretched 8% prior to artificial aging at 325° F.
Figure 2B:
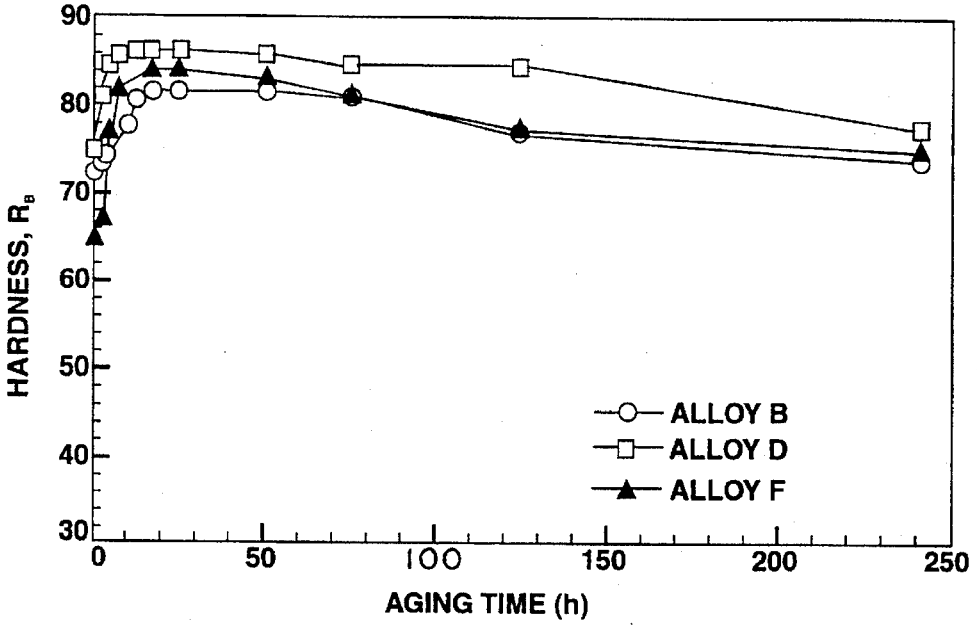
FIG. 2*b* is a graph comparing the Rockwell B hardness values for alloy samples K, L and M after specimens of each were naturally aged for 10 days prior to artificial aging at 325° F.

In FIGS. 2*a* and 2*b*, Rockwell B hardness values are plotted as a function of aging time at 325° F. for Ag-bearing alloy samples B, D and F from Table I, i.e. those representative of low, intermediate and high Cu:Mg ratios, respectively. The highest hardness values were observed in T8-type tempers of the alloy samples with low to intermediate Cu:Mg ratio (samples B and D) and, in the T6-type temper, of only one alloy sample having an intermediate Cu:Mg ratio (alloy sample D).

Figure 3:
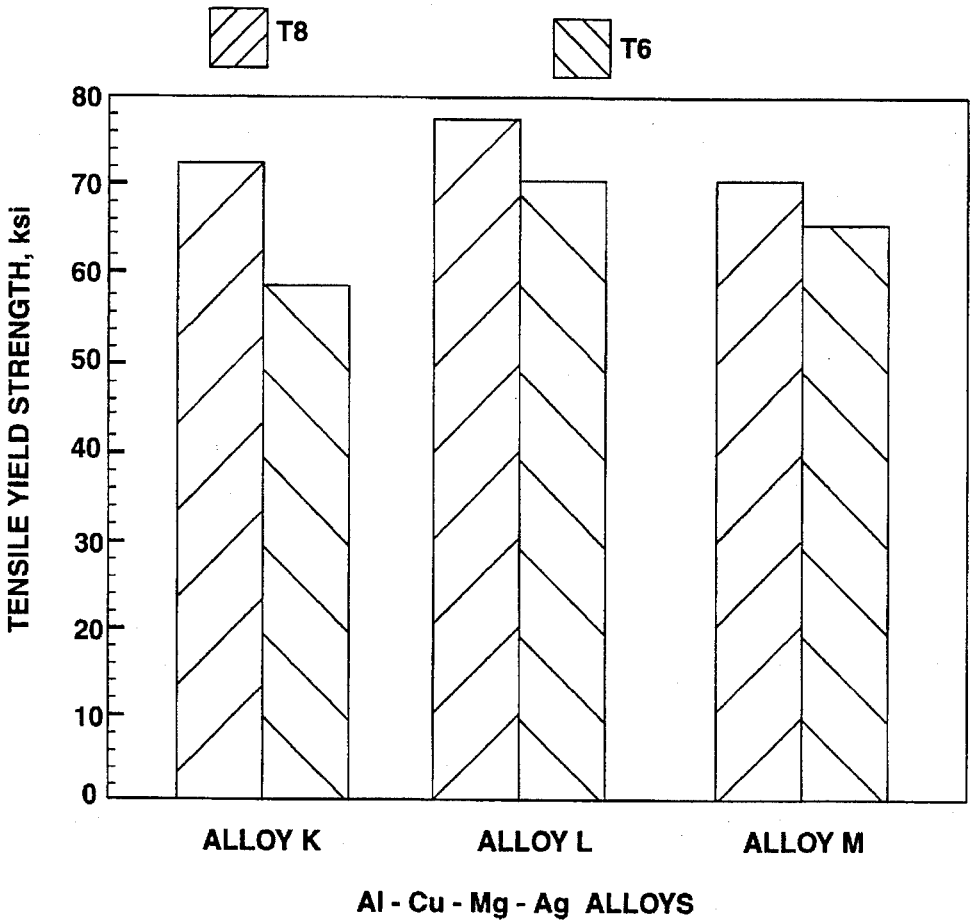
FIG. 3 is a graph comparing the typical tensile yield strengths of alloy samples K, L and M after each were aged to a T8- and T6-type temper respectively.

The benefit of this invention's intermediate Cu:Mg ratios is further demonstrated in FIG. 3 and following Table V. Both presentations show that alloy samples with an intermediate Cu:Mg ratio (e.g., alloy sample L) develop the highest tensile yield strengths of three samples compared in T6- and T8-type tempers.

TABLE V

Typical Tensile Data and Rockwell B Hardness Values for Al—Cu—Mg—Mn—Ag Sheet Aged Using T6-type and T8-type Practices, Illustrating the Effect of Cu:Mg Ratios

| Sample (a) | Cu:Mg Ratio | Temper | HRB | Tensile Yield Strength (ksi) | Ultimate Tensile Strength (ksi) | Elongation (1%) |
|---|---|---|---|---|---|---|
| K | 2.75 | T6 | 81.4 | 57.7 | 73.1 | 16.0 |
| | | T8 | 86.6 | 72.6 | 77.8 | 14.0 |
| L | 6.25 | T6 | 86.4 | 71.0 | 76.5 | 13.0 |
| | | T8 | 87.5 | 77.4 | 80.0 | 13.0 |

TABLE V-continued

Typical Tensile Data and Rockwell B Hardness Values for Al—Cu—Mg—Mn—Ag Sheet Aged Using T6-type and T8-type Practices, Illustrating the Effect of Cu:Mg Ratios

| Sample (a) | Cu:Mg Ratio | Temper | HRB | Tensile Yield Strength (ksi) | Ultimate Tensile Strength (ksi) | Elongation (1%) |
|---|---|---|---|---|---|---|
| M | 20.0 | T6 | 84.2 | 66.8 | 76.5 | 13.0 |
| | | T8 | 84.9 | 70.7 | 76.8 | 13.0 |

(a) All were cast as 1¼" × 2¾" × 6" ingots and rolled to sheet.

Effect of Mg

It is believed that sufficient amounts of silver promote the formation of a plate-like Ω phase on the {111} planes of this invention. At the lower Cu:Mg ratios of about 2.9 (4.4 wt. %:1.5 wt. %), this Ω phase is dominant thereby replacing the GPB zones and S' particulates that would otherwise be expected for such an alloy. At higher Cu:Mg ratios of about 20 (or 6 wt. %:0.3 wt. %), these Ω phases replace the {100} GP zones and {100} Θ' precipitates. At the preferred intermediate Cu:Mg ratios of this invention, the Ω phase is still dominant.

Effects of Mn

Table VI shows the effect of Mn additions on typical tensile properties of the Al-Cu-Mg-Mn-(Ag) alloy samples aged to T8-type tempers. Alloys with two or more Mn levels have been grouped together with companion alloy samples having roughly the same Ag levels and Cu:Mg ratios.

TABLE VI

Typical Tensile Data for Al—Cu—Mg—Mn—(Ag) Sheet Aged Using T8-type Practices, Illustrating the Effect of Mn

| | | | T8-type (b) | | |
|---|---|---|---|---|---|
| Sample (a) | Description | Mn (wt %) | Tensile Yield Strength (ksi) | Ultimate Tensile Yield Strength (ksi) | Elongation (%) |
| H | intermed Cu:Mg w/Ag | 0.06 | 71.8 | 74.5 | 8.0 |
| D | intermed Cu:Mg w/Ag | 0.60 | 75.4 | 77.5 | 11.0 |
| G | intermed Cu:Mg no Ag | 0.06 | 65.1 | 69.8 | 10.0 |
| C | intermed Cu:Mg no Ag | 0.60 | 72.6 | 74.8 | 9.0 |
| I | high Cu:Mg no Ag | 0.06 | 65.4 | 71.5 | 13.0 |
| E | high Cu:Me no Ag | 0.60 | 67.7 | 72.9 | 11.0 |
| J | high Cu:Mg w/Ag | 0.05 | 64.6 | 70.5 | 13.0 |
| F | high Cu:Mg w/Ag | 0.60 | 68.7 | 74.0 | 12.0 |
| R | intermed Cu:Mg w/Ag | 0.00 | 73.4 | 76.2 | 10.0 |
| S | intermed Cu:Mg w/Ag | 0.60 | 76.2 | 79.8 | 9.5 |
| Q | high Cu:Mg w/Ag | 0.30 | 70.4 | 74.4 | 11.0 |
| U | high Cu:Mg w/Ag | 0.60 | 73.5 | 77.2 | 9.5 |
| V | high Cu:Mg w/Ag | 1.01 | 74.4 | 77.7 | 9.5 |

(a) Samples H, D, G, C, I, E, J and F were cast as 1¼" × 2¾" × 6" ingots and rolled to sheet. Samples R, S, Q, U, and V were direct chill cast as 6" × 16" × 60" ingots.
(b) Typical T8-type properties were obtained from sheet which had been heat treated, quenched, stretched 8% and artificially aged at temperatures between 325° F. and 350° F.

Figure 4:
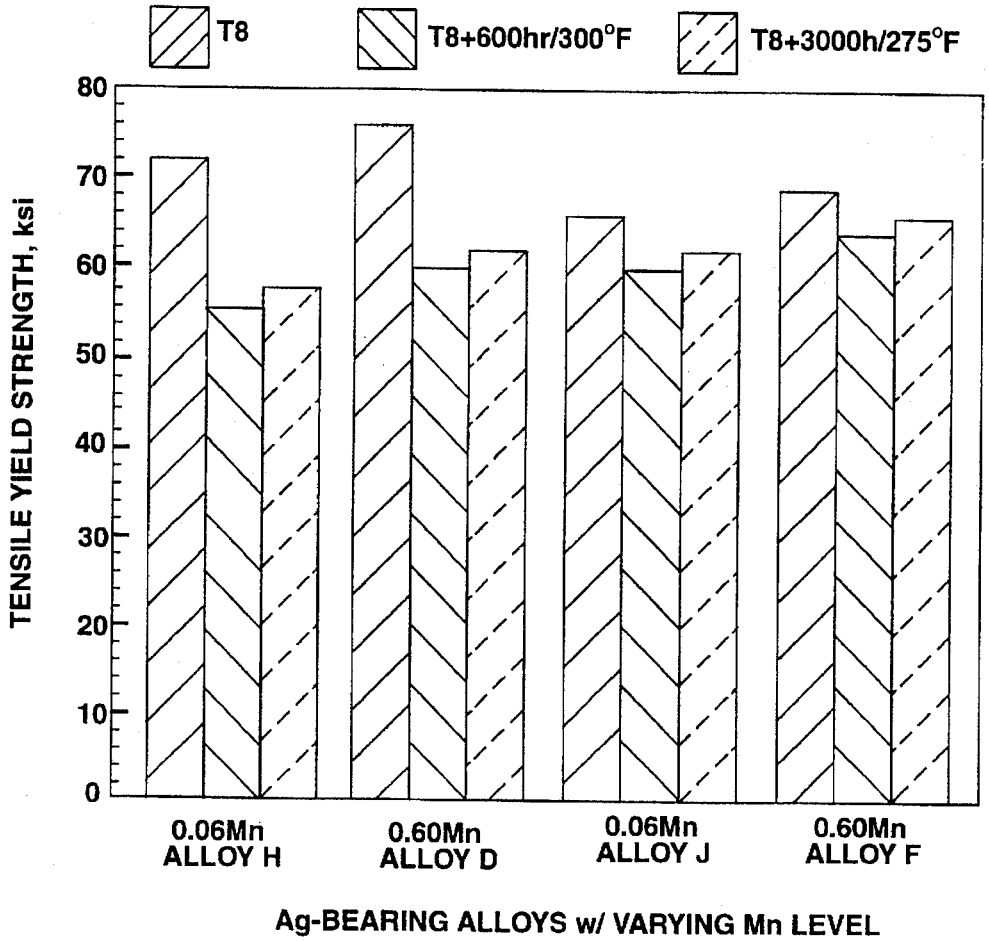
FIG. 4 is a graph comparing typical tensile yield strengths of alloy samples H, D, J, and F from Table I, all of which were aged to a T8- type temper, then subjected to exposure conditions for simulating Mach 2.0 service.

Manganese additions of around 0.6 wt. % typically provide about 3 ksi or more of added strength to these alloy samples. For example, the Ag-bearing, Mn-free alloy with an intermediate Cu:Mg ratio, alloy sample R, developed a typical T8-type tensile yield strength of 73.4 ksi while its Mn-bearing equivalent (alloy sample S) developed a typical T8-type tensile yield strength of 76.2 ksi. FIG. 4 shows that the strength advantage attributable to Mn is not lost in these alloy samples as a result of extended exposures to either 600 hours at 300° F. or 300 hours at 275° F.

Effects of Zn

Substitution of Zn for at least some of the Ag in this invention does not appear to have a significant deleterious effect on the strength levels and other main properties of these alloy products. Instead, zinc substitutions for silver serve a positive purpose of cost reduction in these alternate embodiments. Table VII compares the typical sheet strengths of a silver-only sample (alloy sample W), zinc-only sample (alloy sample X) and a silver-and-zinc comparative (alloy sample Y) after each were artificially aged following stretching to various levels of 0.5%, 2% and 8%.

TABLE VII

Typical Tensile Data for Al—Cu—Mg—Mn—(Ag, Zn) Sheet Aged After 0.5%, 2% and 8% Stretching. Illustrating the Effects of Ag and Zn

| | | 0.5% Stretch | | | 2% Stretch | | | 8% Stretch | | |
|---|---|---|---|---|---|---|---|---|---|---|
| Sample | Nucleating Aid(s) (wt. %) | Tensile Yield Strength (ksi) | Ultimate Tensile Strength (ksi) | Elongation (%) | Tensile Yield Strength (ksi) | Ultimate Tensile Strength (ksi) | Elongation (%) | Tensile Yield Strength (ksi) | Ultimate Tensile Strength (ksi) | Elongation (%) |
| W | 0.5 Ag | 72.5 | 77.4 | 13.0 | 73.3 | 77.7 | 13.0 | 77.3 | 80.1 | 12.6 |
| X | 0.36 Zn | 65.3 | 72.6 | 13.0 | 68.4 | 74.3 | 12.0 | 74.6 | 76.4 | 10.0 |
| Y | 0.25 Ag and 0.16 Zn | 70.1 | 76.1 | 12.0 | 71.6 | 76.6 | 12.0 | 75.9 | 78.2 | 11.0 |

Fracture Toughness

Figure 5:
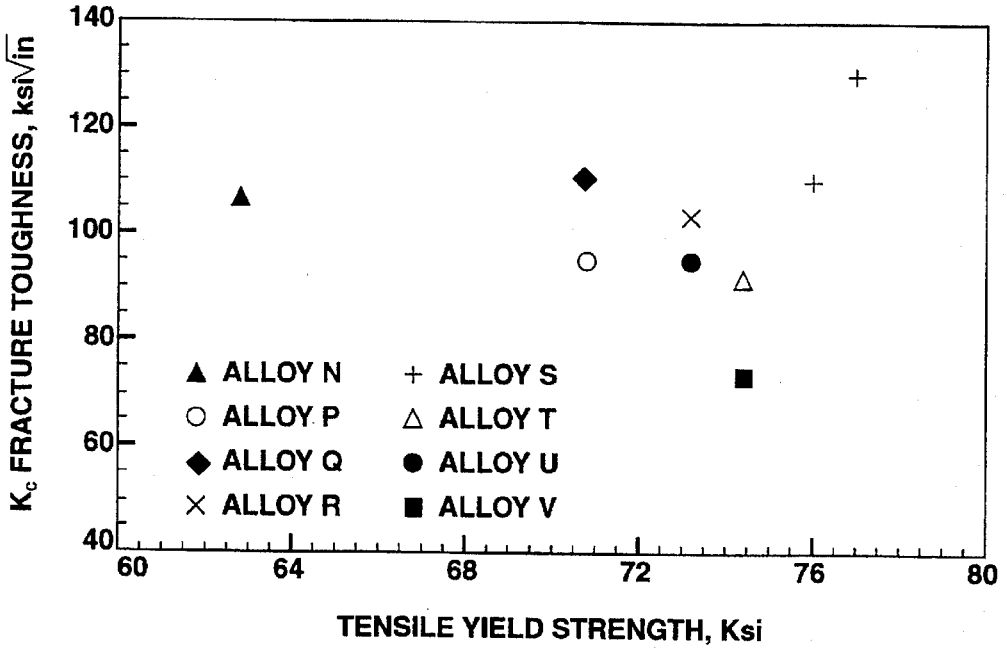
FIG. 5 is a graph comparing the plane stress fracture toughness (or $K_c$) values versus typical tensile yield strengths for alloy sheet samples N, P, Q, R, S, T, U and V from Table II, after each had been artificially aged to a T8-type temper.
Figure 6:
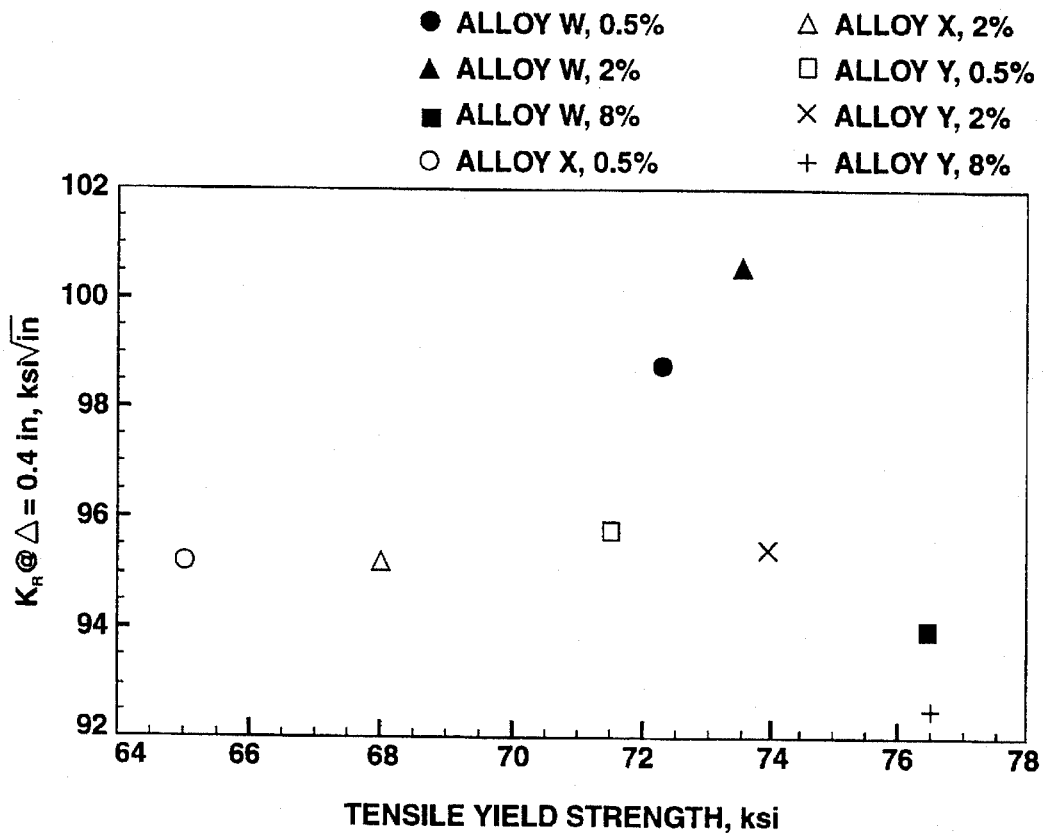
FIG. 6 is a graph comparing $K_r$ crack extension resistance values at $\Delta a_{eff}$=0.4 inch versus typical tensile yield strengths for alloy samples W, X and Y from Table III when stretched by either 0.5%, 2% or 8% prior to artificial aging at 325° F.

The strength/toughness combinations of various Al-Cu-Mg-Mn-(Ag-Zn) alloy samples are compared in accompanying FIGS. 5 and 6. The data from FIG. 5 is summarized in Table VIII below.

TABLE VIII

Typical Tensile and Fracture Toughness Data for Al—Cu—Mg—Mn—(Ag) Sheet

| Sample | Temper | Tensile Yield Strength (ksi) | $K_C$ Fracture Toughness (ksi√in) |
|---|---|---|---|
| N | T8 | 62.8 | 105.2 |
| P | T8 | 70.3 | 94.5 |
| Q | T8 | 70.4 | 110.4 |
| R | T8 | 73.4 | 102.4 |
| S | T8 | 76.2 | 107.7 |
| S | T8 | 77.4 | 129.4 |
| T | T8 | 74.5 | 92.7 |
| U | T8 | 73.5 | 95.4 |
| V | T8 | 74.4 | 72.2 |

From this data, an Ag-bearing alloy with an intermediate Cu:Mg ratio (alloy sample S in FIG. 5 and alloy sample W in FIG. 6) developed the best overall combination of strength and toughness. The alloy for which a partial substitution of Zn for Ag was made (alloy sample Y) developed nearly as high a combination of strength and toughness properties.

One of the alloys investigated above, alloy sample Q, very closely resembles the composition of several examples in the Polmear patent. Table IX compares the typical tensile yield strengths noted by Polmear, and those of alloy sample Q to those observed for this invention. Note that Polmear obtained typical tensile yield strengths of up to 75 ksi for his extruded rod examples. But sheets of a similar composition, produced on this inventor's behalf for comparison purposes, attained only typical tensile yield strengths of 68 to 70 ksi. One preferred embodiment of this invention in sheet form, alloy sample S, developed typical tensile yield strengths as high as 77 ksi in the T8-type temper, or 10% higher typical yield strengths than those achieved by a Polmear-like composition in a comparative sheet product form. Presumably, alloy sample S would develop even higher strength levels if fabricated as an extrusion since extruded bars and rods are known to develop enhanced texture strengthening.

TABLE IX

Comparison of Typical Tensile Yield Strengths Obtained on Polmear Patent Extrusions to Those Obtained in the Current Study with the Invention Alloy and Other Alloy Samples

| Alloy composition (wt. %) | Product Form | Temper | Tensile Yield Strength (ksi) | Reference |
|---|---|---|---|---|
| Al-6Cu-0.Mg-0.4Ag -0.5Mn-0.15Zr-0.1V-0.04Si | extruded rod | T6 | 75.1 | from the Polmear patent |
| Al-5.3Cu-0.6Mg-0.3Ag -0.5Mn-0.25Zr 0.15V-0.08Si | extruded rod | T6 | 71.0 | from the Polmear patent |
| Al-6.7Cu-0.4Mg-0.8Ag -0.8Mn-0.15Zr 0.05V-0.06Si | extruded rod | T6 | 73.9 | from the Polmear patent |
| Al-6Cu-0.5Mg-0.4Ag -0.5Mn-0.15Zr 0.1V-0.04Si | extruded rod | T6 | 75.4 | from the Polmear patent |
| Al-5.75Cu-0.5Mg-0.5Ag -0.3Mn-0.16Zr 0.09V-0.05Si | sheet | T8 | 70.4 | make for comparative purposes |
| (Alloy sample Q) | sheet | T6 | 68.3 | make for |

TABLE IX-continued

Comparison of Typical Tensile Yield Strengths Obtained on Polmear Patent Extrusions to Those Obtained in the Current Study with the Invention Alloy and Other Alloy Samples

| Alloy composition (wt. %) | Product Form | Temper | Tensile Yield Strength (ksi) | Reference |
|---|---|---|---|---|
| | | | | comparative purposes |
| Al-5.12Cu-0.82Mg-0.5Ag -0.6Mn-0.15Zr -0.13V-0.06Si (Alloy sample S) | sheet | T8 | 76.2 77.9 | invention alloy sample |
| | forgings | T6 | 74.2 | invention alloy sample |
| Al-4.8Cu-0.8Mg-0.5Ag -0.6Mn-0.15Zr (Alloy sample W) | sheet | T8 | 77.3 | invention alloy sample |
| Al-4.8Cu-0.8Mg-0.25Ag -0.6Mn-0.15Zr (Alloy sample V) | sheet | T8 | 75.9 | invention alloy sample |

Additional tensile specimens were artificially aged by T6-type and T8-type practices, then exposed to elevated temperature conditions intended to simulate Mach 2.0 service. Such exposures included heat treatments at 300° F. for 600 hours and at 275° F. for 3000 hours. After 300° F. exposures for 600 hours, typical T8-type tensile yield strengths of the invention dropped only from about 8 to 12 ksi. Somewhat smaller losses of only 5 to 10 ksi were observed following 275° F. exposures for 3000 hours. Such typical strength levels, nevertheless, represent a considerable high temperature improvement over the minimum levels observed for 2618 aluminum and other existing alloys.

Figure 7A:
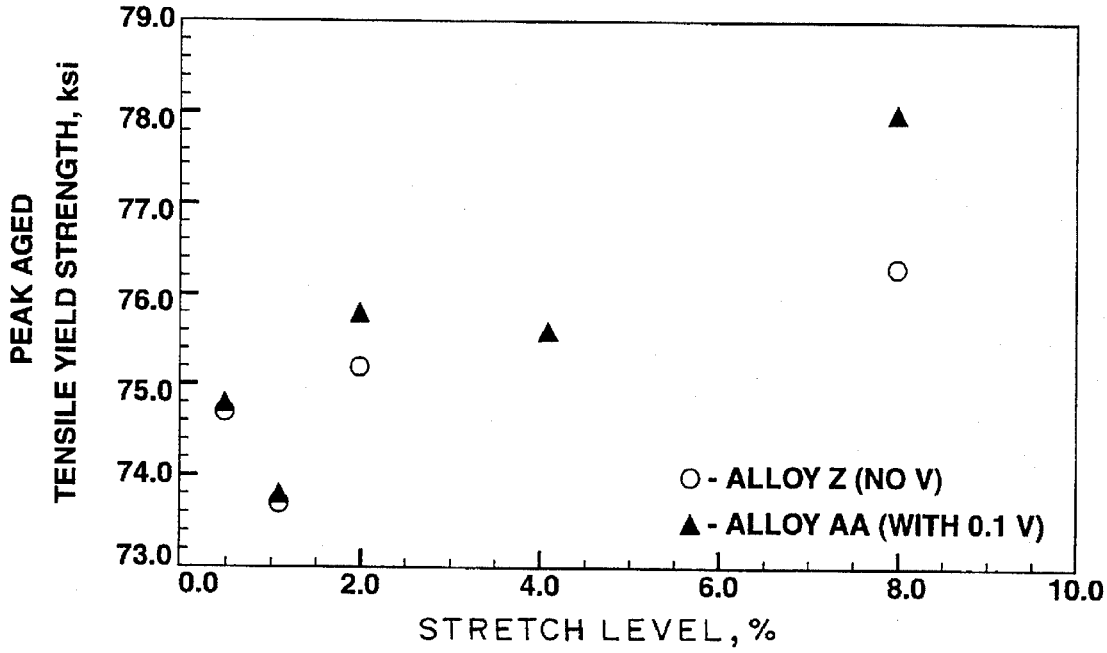
FIG. 7*a* is a graph comparing typical tensile yield strengths of zirconium-free alloy samples Z and AA from Table III when stretched by various percentages prior to artificial aging at 325° F. to show the affect of vanadium thereon.
Figure 7B:
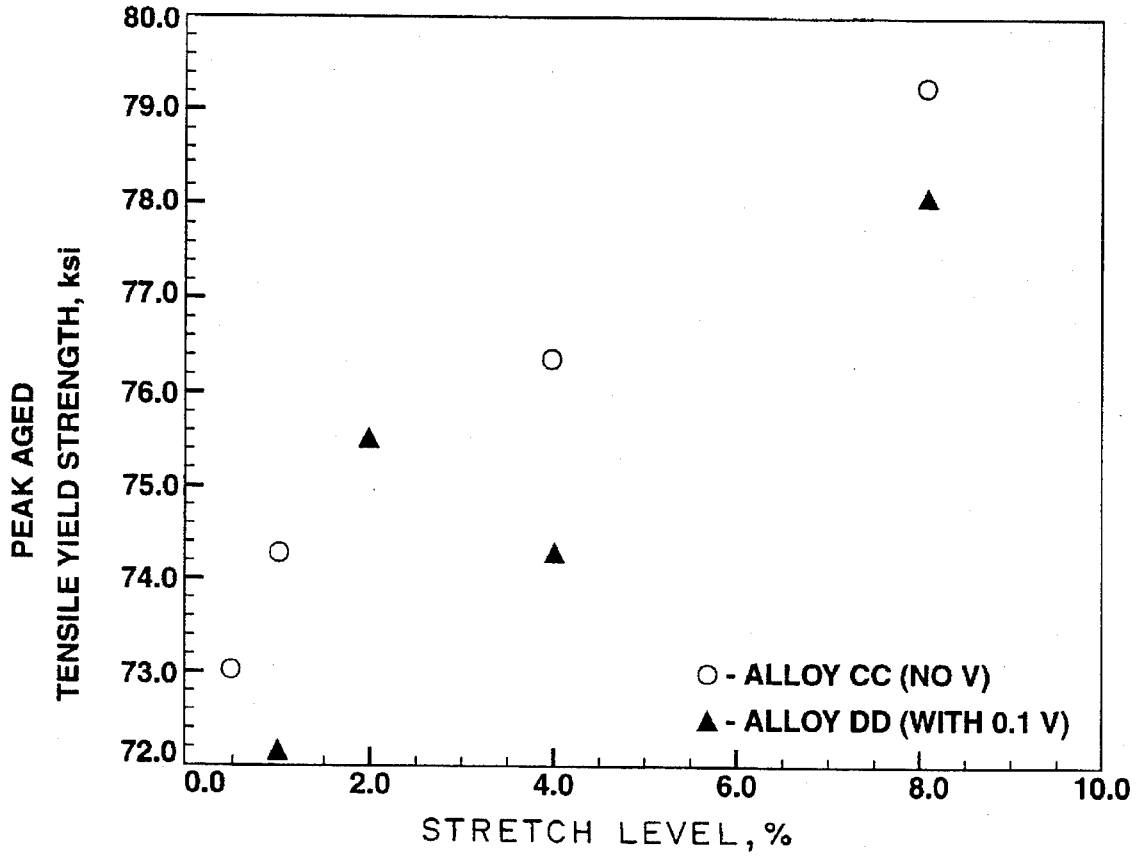
FIG. 7*b* is a graph comparing typical tensile yield strengths of zirconium-free alloy samples CC and DD from Table III when stretched by various percentages prior to artificial aging at 325° F. to show the affect of vanadium thereon.

From the data set forth in FIG. 7*a*, for both zirconium-bearing alloys, it was observed that roughly equivalent typical strength levels (less than 1 ksi difference) were measured for alloy samples Z and AA, regardless of the amount of stretch imparted to these two comparative compositions differing primarily in vanadium content. While in their zirconium-free equivalents, alloy samples CC and DD in FIG. 7*b*, the presence of vanadium actually had a deleterious effect on observed typical strength values.

For one particular product form, forged aircraft wheels manufactured from a composition containing 5.1 wt. % copper, 0.79 wt. % magnesium, 0.55 wt. % silver, 0.62 wt. % manganese, 0.14 wt. % zirconium, the balance aluminum and incidental elements and impurities, slightly lower typical yield strengths, on the order of 72 ksi, were observed. But it is believed that such minor strength decreases resulted from the slow quench imparted to these wheels for lowering the residual stresses imparted to the end product. These wheel samples were also aged at a slightly higher than preferred final aging temperature to more closely model plant scale conditions.

Based on the foregoing, most preferred embodiments of this invention are believed to contain about 5.0 wt. % Cu, an overall Mg level of about 0.8 wt. %, an Ag content of about 0.5 wt. %, an overall Mn content of about 0.6 wt. % and a Zr level of about 0.15 wt. %.

Having described the presently preferred embodiments, it is to be understood that the invention may be otherwise embodied within the scope of the appended claims.

What is claimed is:

1. An extruded structural member having improved combinations of strength and toughness and a typical tensile yield strength of about 77 ksi or higher at room temperature, said structural member made from a substantially vanadium-free, aluminum-based alloy consisting essentially of: about 4.85–5.3 wt. % copper, about 0.5–1.0 wt. % magnesium, about 0.4–0.8 wt. % manganese, about 0.2–0.8 wt. % silver, up to about 0.25 wt. % zirconium, up to about 0.1 wt. % silicon, and up to about 0.1 wt. % iron, the balance aluminum, incidental elements and impurities.

2. The structural member of claim 1 which is an aircraft wing member.

3. The structural member of claim 1 which is an aircraft stringer.

4. The structural member of claim 1 wherein said alloy has a Cu:Mg ratio between about 5 and 9.

5. The structural member of claim 4 wherein the Cu:Mg ratio of said alloy is between about 6.0 and 7.5.

6. The structural member of claim 1 wherein said alloy includes about 5.0 wt. % or more copper.

7. The structural member of claim 1 wherein said alloy further includes up to about 0.5 wt. % zinc.

8. An age formable, extruded structural member suitable for aerospace applications and having improved combinations of strength and toughness and a typical tensile yield strength of about 77 ksi or higher at room temperature, said structural member being made from a substantially vanadium-free aluminum-based alloy consisting essentially of: about 4.85–5.3 wt. % copper, about 0.5–1.0 wt. % magnesium, about 0.4–0.8 wt. % manganese, about 0.2–0.8 wt. % silver, about 0.05–0.25 wt. % zirconium, up to about 0.1 wt. % silicon, and up to about 0.1 wt. % iron, the balance aluminum, incidental elements and impurities.

9. The structural member of claim 8 which is an aircraft wing member.

10. The structural member of claim 8 wherein said alloy has a Cu:Mg ratio between about 6.0 and 7.5.

11. The structural member of claim 8 wherein said alloy includes about 5.0 wt. % or more copper.

12. The structural member of claim 8 wherein said alloy further includes up to about 0.5 wt. % zinc.

13. An extruded aerospace structural member having improved combinations of strength and toughness and a typical tensile yield strength of about 77 ksi or higher at room temperature, said structural member being made from a substantially vanadium-free, aluminum-based alloy consisting essentially of: about 4.85–5.3 wt. % copper, about 0.5–1.0 wt. % magnesium, about 0.4–0.8 wt. % manganese, about 0.2–0.8 wt. % silver, up to about 0.25 wt. % zirconium, up to about 0.1 wt. % silicon, and up to about 0.1 wt. % iron, the balance aluminum, incidental elements and impurities, said alloy having a Cu:Mg ratio between about 5 and 9.

14. The extruded structural member of claim 13 wherein the Cu:Mg ratio of said alloy is between about 6.0 and 7.5.

15. The extruded structural member of claim 13 which has been stretched by at least about 1% to improve its straightness and further to enhance its strength properties.

16. The extruded structural member of claim 13 which has been solution heat treated at one or more temperatures between about 955°–980° F. (513°–527° C.).

17. The extruded structural member of claim 13 wherein said alloy includes about 5.0 wt. % or more copper.

18. The extruded structural member of claim 13 wherein said alloy further includes up to about 0.5 wt. % zinc.

* * * * *